United States Patent [19]

Ott et al.

[11] Patent Number: 4,981,008

[45] Date of Patent: Jan. 1, 1991

[54] TOMATO PACKING MACHINE

[75] Inventors: Edward L. Ott, Smyrna, Ga.; James P. Zavodsky, Schaumburg; Carl D. Deshich, Elmhurst, both of Ill.

[73] Assignee: Restaurant Technology, Inc., Oak Brook, Ill.

[21] Appl. No.: 357,378

[22] Filed: May 25, 1989

[51] Int. Cl.[5] ..... B65B 25/04; B65B 35/32; B65B 35/46; B65B 35/54

[52] U.S. Cl. ..... 53/443; 53/475; 53/500; 53/502; 53/531; 53/247

[58] Field of Search ..... 53/534, 531, 497, 499, 53/500, 502, 244, 247, 443, 475, 473

[56] References Cited

U.S. PATENT DOCUMENTS

| | | | |
|---|---|---|---|
| 2,896,384 | 7/1959 | Carlsen et al. | 53/502 |
| 3,126,088 | 3/1964 | Dudas | 53/499 X |
| 3,169,354 | 2/1965 | Bliss et al. | 53/499 |
| 3,311,216 | 3/1967 | Jones | 53/534 X |
| 3,416,619 | 12/1968 | McClusky | 53/502 X |
| 3,633,732 | 1/1972 | Russell et al. | 53/500 |
| 3,705,475 | 12/1972 | Riley | 53/502 X |
| 3,730,386 | 5/1973 | Monsees | 53/500 X |
| 3,735,552 | 5/1973 | Derderian | 53/534 X |
| 3,820,301 | 6/1974 | Willsey | 53/499 |
| 4,009,553 | 3/1977 | Monjo | 53/534 |
| 4,428,179 | 1/1984 | Jordon et al. | 53/502 |
| 4,575,993 | 3/1986 | Meyn | 53/534 |
| 4,674,259 | 6/1987 | Hills | 53/247 X |
| 4,730,440 | 3/1988 | van der Shoot et al. | 53/497 X |

*Primary Examiner*—Horace M. Culver
*Attorney, Agent, or Firm*—Jenner & Block

[57] ABSTRACT

A packing machine for tomatoes or the like has a rear portion with a low backline pressure conveyor arranged into plural lanes divided by tapered walls. The rear portion of the machine is reciprocated sideways so that bulk tomatoes entering the rear of the machine are distributed among the several lanes. Tomatoes are transported to a station where a paddle wheel with flexible arms prevents the forward progress of tomatoes until sensing apparatus determines that a plurality of lane positions are filled by tomatoes. Then a row of tomatoes are discharged through a front chute into a single layer carton. An escrow lane has entry and exit control devices which are responsive to a manually operated switch to add further tomatoes to the carton. The carton is at an incline and reciprocates back-and-forth so that tomatoes nest in a single layer, and are packed more densely thereby. The machine can pack by weight or by count.

28 Claims, 9 Drawing Sheets

FIG. 8
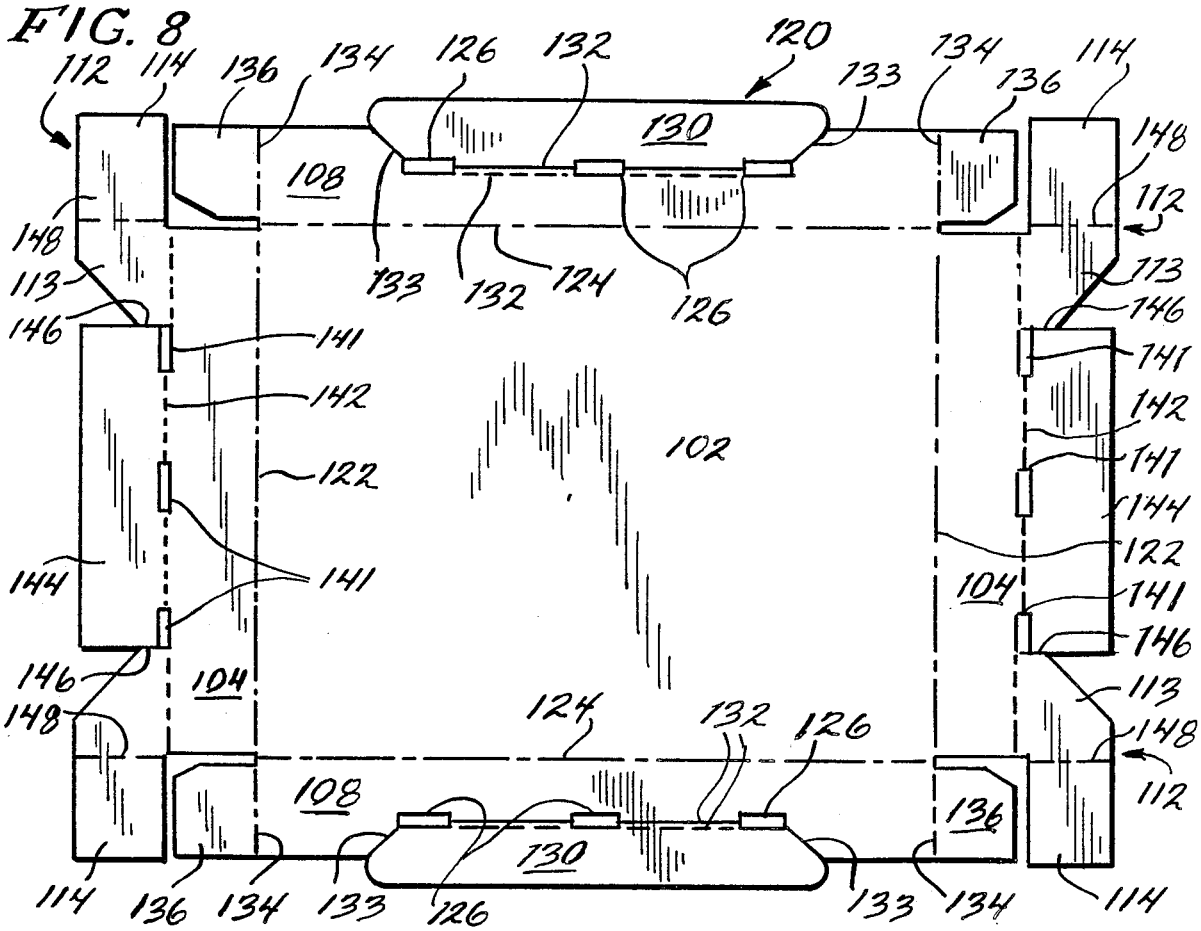
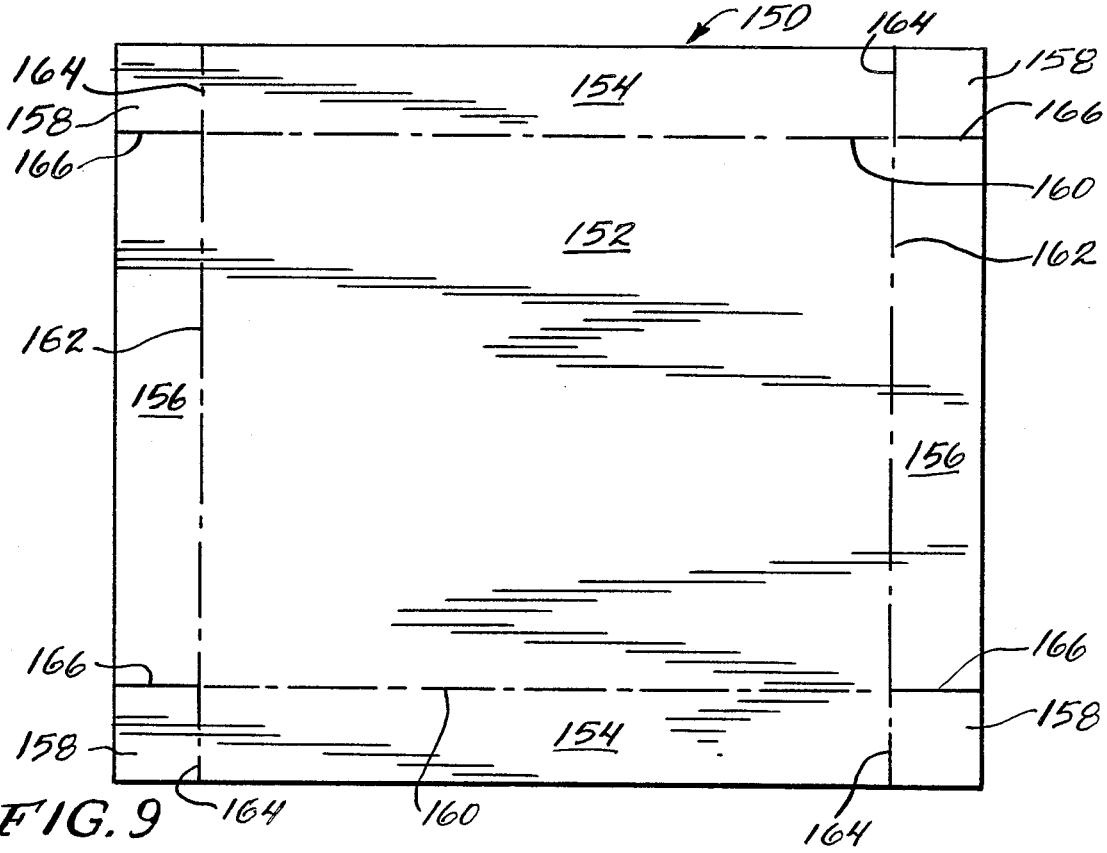
FIG. 9

TOMATO PACKING MACHINE

FIELD OF THE INVENTION

The present invention relates to packaging tomatoes or other objects, especially objects which are not geometrically similar or spherical (such as most fruits), as well as spherical products, whether natural or manufactured.

BACKGROUND OF THE INVENTION

When tomatoes are harvested and sorted, they normally are packaged in standard 25 pound bulk pack boxes. Each such box normally holds between 72 and 84 tomatoes, without using dividers. Growers ship the produce to a tomato repacker who checks the tomatoes for quality, sorting them by size and color. The tomatoes are repacked into standard 25 pound bulk boxes and shipped to grocery stores, restaurants and other retailers and users.

Packing tomatoes in the 25 pound bulk box, which ordinarily has a dimension on the order of 8 inches depth by 12 inches width by 18.5 inches length, permits damage to individual tomatoes during ripening, packing, or transit relatively easily. The 25 pound bulk box allows pressure to develop on individual tomatoes and encourages spoilage and concussion bruising. Also, cross-contamination can occur, where, for example, one rotten tomato can ruin its neighboring tomatoes, particularly the ones below. When the bulk shipment is received at the destination, such as a restaurant, the tomatoes can be sorted, and waste or spoiled tomatoes can be discarded. If they are not promptly sorted at the delivery destination or restaurant, further tomato spoilage occurs.

It is therefore desirable to package tomatoes in a fashion that they are less likely to be damaged in transit and so that spoilage of one tomato, either during transit or thereafter, is less apt to spoil numerous tomatoes in the box.

It has been discovered that growers or repackers can package the tomatoes in a single layer thereby reducing the likelihood of spoilage. The advantages of packaging the tomatoes in a single layer are disclosed in a related application filed simultaneously herewith by P. Petriekis, M. Janis, P. Robinson and E. Ott entitled "Food Carton and Method", Ser. No. 07/357,379, the disclosure of which is incorporated by this reference. However, packaging the tomatoes manually in a single layer greatly increases the cost of the tomatoes.

A need therefore exists to provide an apparatus and method for packaging tomatoes which is not labor intensive, which packs the tomatoes into a single layer carton, and which packages the tomatoes more efficiently within each carton. Also, an object of the invention is to provide the ability to pack tomatoes by count or by weight.

SUMMARY OF THE INVENTION

A packing machine has been invented to cooperate most advantageously with an inventive carton, although the inventive carton is usable with other machinery and for other purposes, and the inventive machine is usable with other cartons and other products.

The packing machine generally includes a rear portion which receives bulk items to be packed, such as tomatoes or the like, for example, and transports them to a counting station. The counting station determines that a predetermined number of items have arrived in prescribed side-by-side lanes and are ready to exit via the front portion into a carton. The front portion of the machine receives the items from a holding station and rolls them along an incline into the carton. Preferably the carton is located on a conveyor such as a roller or skate conveyor at a transverse angle from horizontal so that gravity assists the continued rolling motion of the items in the carton to facilitate its loading.

More particular features of the rear portion of the preferred embodiment of the packing machine are that a conveyor, preferably a low back line pressure chain, is arranged in plural lanes which in the aggregate can be wider than a conveyor chute which receives the items from a bulk packaging box. Appropriate mechanical means oscillates the several lanes as a group in a lateral direction to enhance the spacing between the items delivered by the chute onto the wider group of lanes. Mechanical lane dividers separate the items into lanes. Each lane preferably includes internal guide walls which narrow the dimension of each lane near the holding station. This narrowing reduces the tendencies of the tomatoes to wedge by controlling their relative orientations.

The holding station illustratively comprises a paddle wheel arrangement having rubber or rubber-like blades that define compartments for containing a row of items, which may be an individual piece of fruit or vegetable from each lane. After sensors determine that all the lanes have respective items at the holding station, the paddle wheel rotates and causes the row of items to move to the front portion of the machine where they roll and/or slide down another chute which guides them into the single layer carton. The items roll on their sides and through a nesting effect become efficiently and densely packaged.

BRIEF DESCRIPTION OF THE DRAWINGS

In the drawings:

FIGS. 8 and 9 are plan views of unassembled blanks of the carton and lid in FIG. 6, respectively;

DESCRIPTION OF THE PREFERRED EMBODIMENT

Figure 1:
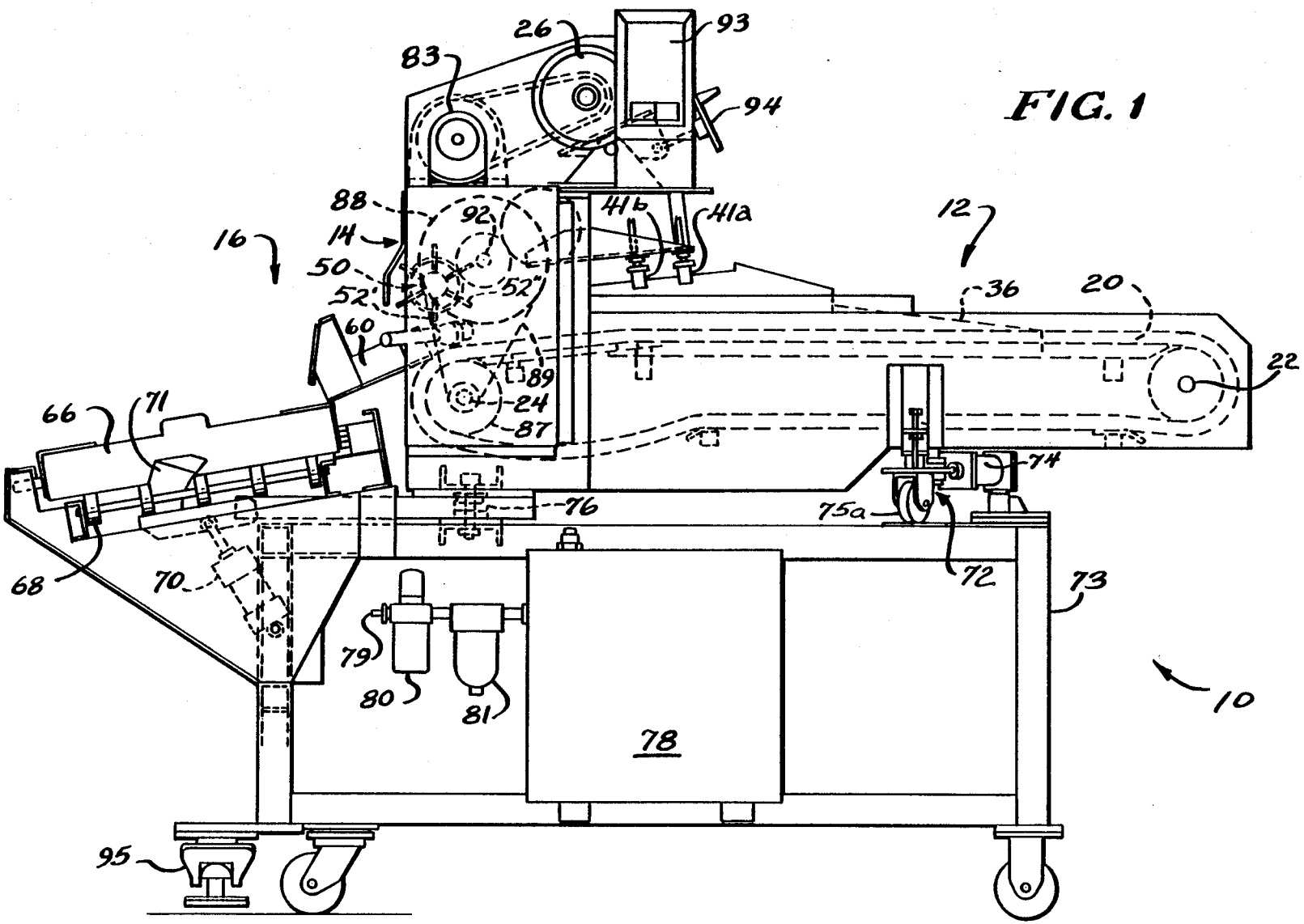
FIG. 1 is a side elevation view of a packing machine according to the present invention.
Figure 2:
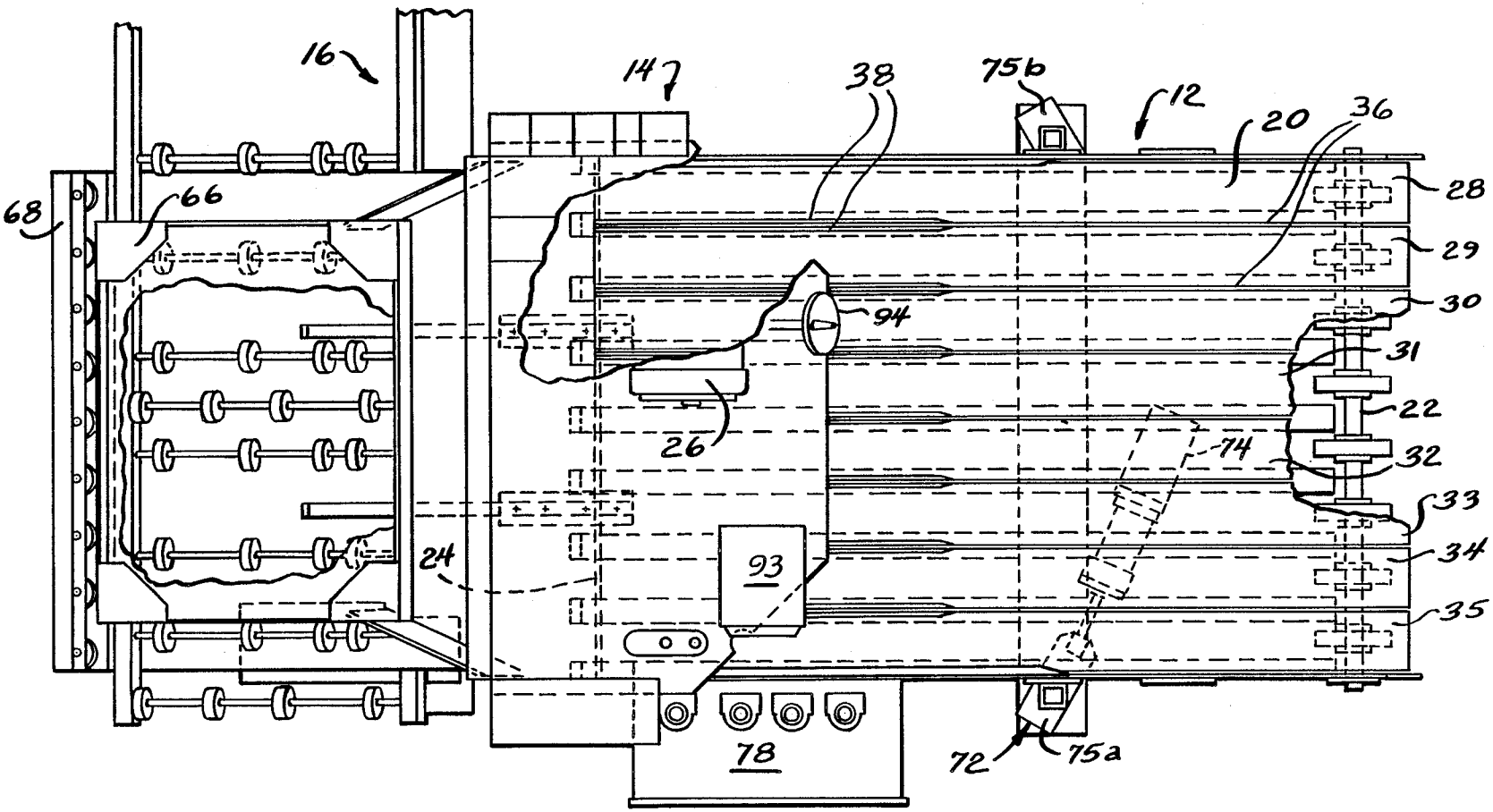
FIG. 2 is a plan view with parts broken away of the machine shown in FIG. 1.

A packing machine 10 according to the present invention is shown in FIGS. 1 to 5. Although reference is now made to employing the machine to pack tomatoes, it could similarly be used to pack such food products as apples, lemons, peaches, potatoes, onions, and other items, or manufactured goods such as tennis balls. Machine 10 includes a rear portion 12, a holding or counting station 14, and a front portion 16. Rear portion 12 of the machine receives bulk tomatoes and arranges them into lanes (see FIGS. 2 and 4), all in a plane generally parallel to ground, illustratively. Rear portion 12 may cooperate with any device for loading tomatoes onto rear portion 12. For example, an inclined chute (not illustrated) which in plan view is a triangular section with upstanding curved edges can couple the relatively wide rear portion 12 of packing machine 10 to a relatively narrow conveyor (not illustrated) or the like which may be used to receive bulk tomatoes out of boxes, such as standard 25 pound boxes. The conveyor transports the tomatoes to the chute where they roll down the inclined base of the chute onto rear portion 12 of machine 10.

Rear portion 12 preferably includes a conveying apparatus comprising a low backline pressure chain which is illustratively about three feet wide. This conveyor includes several separate but parallel endless conveyor belts 20, each formed by numerous rollers to reduce friction on the items they transport. Such belts are available commercially from Rexnord, and are sometimes called "low back line pressure" or "zero gravity feed" belts or chains. The conveyor belts 20 are rotatably mounted around a tail shaft 22 and a front shaft 24 which is driven by a motor 26 (via gears and sprockets described infra) to transport the tomatoes to counting station 14. As they travel forward, the tomatoes are grouped into eight separate lanes 28, 29, 30, 31, 32, 33, 34 and 35 by divider walls 36 each extending in a direction parallel to the forward movement of the tomatoes. Divider walls 36 taper in height from zero height above the belts near the rear portion of the conveyor to approximately four inches over the belts at the front-most portion (see FIGS. 1 and 4). This allows the tomatoes to be channeled without injury into eight separate lanes.

Preferably seven lanes, 28 to 34, are always active, and the eighth lane 35 is used as an escrow lane. Each divider wall 36 supports one or a pair of tapered walls 38 which taper the lanes to narrower dimensions closer to holding or counting station 14. One purpose of this tapering of the opening is to prevent two tomatoes from becoming wedged side-by-side in any lane. Also, the tapered walls center the tomatoes and help orient them on their sides. Each tapered wall 38 may comprise a one-quarter inch thick UHMW polyethylene strip fastened to each side of a lane.

At counting station 14, a mechanism notes when tomatoes arrive at each of the active lanes. The counting mechanism illustratively includes a respective movable finger 40 (FIG. 4) for each of the seven active lanes, a different mechanism 41 being employed in the escrow lane. Each finger 40 extends from above into the respective lane, but does not fully block passage therethrough by tomatoes. Fingers 40 are coupled to sensors 42 coupled to air logic 44. When a tomato enters an active lane, the corresponding finger 40 is activated by the tomato, which is sensed by the sensor 42. The air logic system determines that tomatoes have arrived in each of the active lanes and therefore are ready to be discharged.

Figure 5:
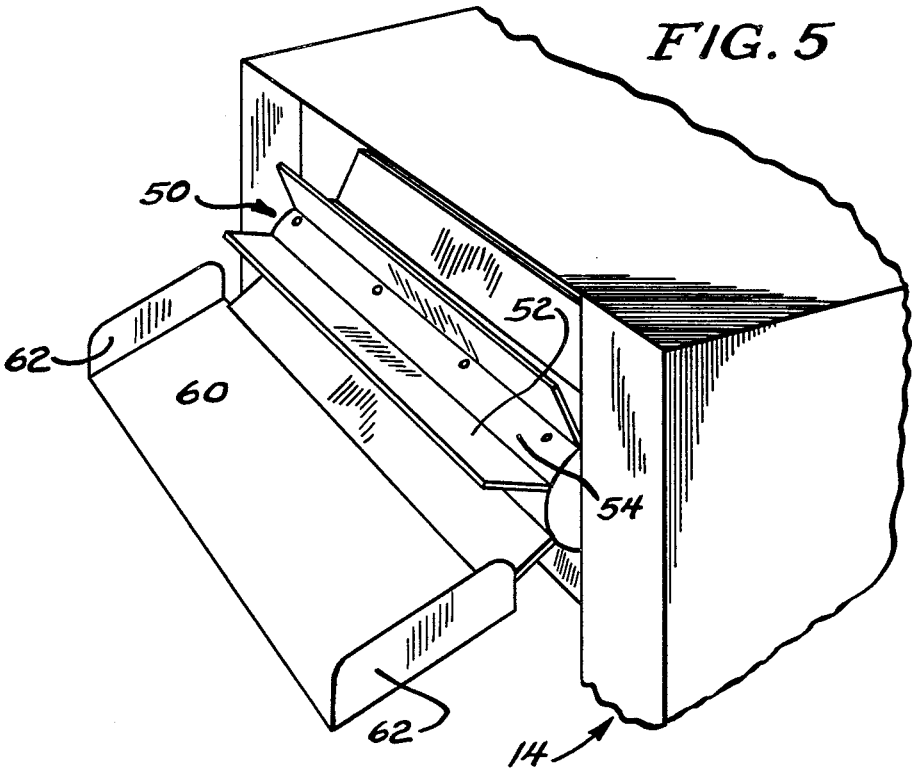
FIG. 5 shows a perspective view of a portion of the illustrated packing machine including the paddle wheel.

Also at counting station 14, a horizontally oriented paddle wheel 50 illustrated partially in FIG. 5 has a plurality, in this case six, radial arms or paddles 52 made of a flexible material such as rubber. Paddles 52 are evenly spaced with respect to each other and extend from a rotatably driven, horizontally oriented cylinder 54 and are dimensioned such that a tomato of the size which is customarily used (such as three inches in diameter or larger) fits into and can be readily transported in the space between each radial arm. Paddle wheel 50 will not rotate until sensors 42 and logic 44 indicate that tomatoes are present in each of the seven active lanes 28 to 34. When the paddle wheel rotates, it transfers the seven tomatoes out of counting station 14 onto a chute 60 where they are guided into a corrugated fiberboard carton 66. Chute 60 may have upstanding side walls 62 to prevent the released tomatoes from falling off the chute.

Mechanism 41 includes air cylinders **41*a* and 41*b* (see FIGS. 1 and 4) positioned at respective locations over or near escrow lane 35. When either cylinder is activated (extended), its arm extends into the escrow lane to prevent passage of tomatoes therepast. When air cylinder 41*a* or 41*b* is retracted, tomatoes can pass by the respective cylinder. The end of the arm is protected by a rubber pad or the like so as not to bruise the tomatoes which enter the escrow slidable track oriented lengthwise with respect to the escrow lane. As such, cylinder 41*a* can be positioned selectively at various locations along escrow lane 35 (generally at the holding station 14). This selective mechanical adjustment of the position of the air cylinder 41*a* will allow adjustment of the number of tomatoes which will be held in escrow lane 35 between air cylinders 41*a* and 41*b*. Air cylinder 41*b* is located at the front of holding station 14**.

Air cylinders **41*a* and 41*b* cooperate to open (retract from lane 35) and close (advance towards lane 35 to block tomato passage) reciprocally to allow a regulated number of escrow tomatoes to pass through holding station 14 during one cycle of operation. In the preferred embodiment, paddle wheel 50 has seven arms, and there are seven active lanes feeding the paddle wheel. One cycle of operation comprises the rotation of nine sections of the paddle wheel. Hence, sixty-three tomatoes are discharged via the paddle wheel in one cycle, and during the cycle, air cylinder 41*b* opens and air cylinder 41*a* closes to permit the tomatoes held in escrow also to be discharged onto chute 60**. It will be appreciated that other arrangements for regulating the discharge of escrow tomatoes may be substituted within the scope of the invention.

In accordance with an important aspect of a preferred embodiment of the invention, the tomatoes are fed to paddle wheel 50 by the conveying apparatus that includes lanes 28–35. Thus, in operation, a tomato (not shown) in each of lanes 28–34 (optionally also in escrow lane 35) is delivered against paddle 52' that extends vertically downwardly, as shown in FIG. 1. Paddle wheel 50 then rotates in a clockwise direction as viewed in FIG. 1 to release a single tomato from each of lanes 28–34 (and optionally one from escrow lane 35) and next paddle 52'' on paddle wheel 50 becomes vertically aligned and extends downwardly until paddle wheel 50 is again activated. The portion of lanes 28–34 adjacent paddle wheel 50 can be slightly inclined downwardly (as illustrated in FIG. 1) to promote the roll of tomatoes into chute 60 when paddle wheel 50 is again rotated to release another row of tomatoes. If any of the tomatoes do not roll or slide into chute 60 when released by rotation of paddle wheel 50, the next paddle of paddle wheel 50 may be designated to sweep the tomato or tomatoes into chute 60.

Carton 66 may be held on a conveyor, preferably a roller or skate device 68, able to deliver cartons in succession to the front of machine 10 and, after the cartons are filled, transport them away from the machine. A sensor switch (not shown) on the front conveyor determines that a carton is indeed in place and ready to receive tomatoes. An arm from a cylinder 70 causes a centering mechanism 71 to rise and engage carton 66 so that it can be centered properly with respect to chute 60 as well as with the rear portion of the machine. Preferably, skate 68 has a slight transverse incline. That is, preferably the floor 102 of carton 66 is not level but instead is inclined at approximately a six or seven degree or more angle, as shown in FIG. 1, so that tomatoes entering the raised end of the carton will roll toward the lower end of the carton. Because tomatoes tend to roll on their sides rather than their bases, when they come to rest in the carton, many or most of them remain on their sides. This permits more tomatoes to be packed into each carton due to a nesting effect and because of the shape of the tomato. A manual operator has little or no remaining work to do to orient the few tomatoes which do not come to rest on their sides.

It should be noted that the tomatoes roll off the loading chute (not illustrated) onto the machine 10 and continue their natural roll all the way toward holding station 14 until they are stopped by paddles 52 of paddle wheel 50, and the extended arm of air cylinder 41*b*. At that point, the tomatoes will be aligned in eight controlled, spaced lanes and will thereafter be released, by rotation of paddle wheel 50 and withdrawal of the arm of cylinder 41*b*, through front chute 60 into carton 66. Carton 66 preferably will oscillate side-to-side after cylinder 70 elevates mechanism 71 to engage carton 66. This front end oscillating motion helps to distribute the rolling tomatoes evenly throughout the carton, promotes the nesting effect of the discharged tomatoes into the box, and thereby permits more efficient packing.

As mentioned, machine 10 oscillates at two locations. Rear portion 12 of the machine with its eight lanes oscillates laterally from side-to-side to help minimize the spacing between rolling tomatoes descending from the entry or loading chute so that tomatoes roll into all of the different lanes. Several means can be used to achieve this. In this embodiment, as shown in FIG. 1, a wheel arrangement 72 permits rear portion 12 to roll on a horizontal cross-member of a frame 73. The second oscillation previously mentioned occurs at the front portion 16 of the machine where the tomatoes are loaded into cartons. Wheel arrangement 72, seen advantageously in FIGS. 1 and 2, includes an air cylinder 74 engaging frame 73. The arm of cylinder 74 suitably engages a first wheel 75*a* mounted for rotation in two dimensions by bearings to rear portion 12. A second wheel 75*b* is also mounted similarly to rear portion 12 via bearings so that rear portion 12 may laterally move. Air cylinder 74 is of the reciprocating type which cooperates with limit switches (not illustrated). While air pressure is applied, the arm of air cylinder 74 extends outward, causing rear portion 12 of machine 10 to be driven in a first lateral direction. When the arm reaches a limit switch, the air cylinder 74 operation reverses direction and pulls the rear portion 12 in the opposite lateral direction. This movement continues until a second limit switch (not shown) is reached which again reverses the movement of air cylinder 74 so that rear portion 12 moves in the first lateral direction again. In this manner, the rear of the machine oscillates laterally. Variable speeds can be developed by the machine.

A main pivot 76 (FIG. 1) is mounted preferably beneath holding station 14 and may comprise illustratively a self-aligning spherical bearing with a pivot weldment. This structure permits the rear oscillation to occur, and at the same time causes the front portion 16 to oscillate laterally from side to side in a manner reciprocal to the oscillations of rear portion 12. The lateral oscillations of front portion 16 permit tomatoes discharged from front portion 16 to become packed more densely in carton 66.

Preferably, an air logic system 78 which includes logic 44 governs the release of tomatoes from the active lanes via the paddle wheel because of its enhanced durability and ability to operate successfully for prolonged periods in hostile environments, such as the repacking or field environments. Initial attempts were made to use photoelectric devices to sense the presence of tomatoes in each lane. However, because of the difference in shades among tomatoes as they ripen, photoelectric sensing has not been satisfactory. The present arrangement, using fingers extending from above and coupled to air logic, senses the presence of a tomato in the corresponding lanes. This is reliable and does not damage the tomatoes. To drive air logic system 78, an air inlet 79 is to be coupled to a compressor (not shown). The compressor may exist independent of the present packing machine or can be provided with the machine if none is otherwise available. A filter 80 and pressure regulator 81 are interposed between inlet 79 and logic system 78.

Figure 3:
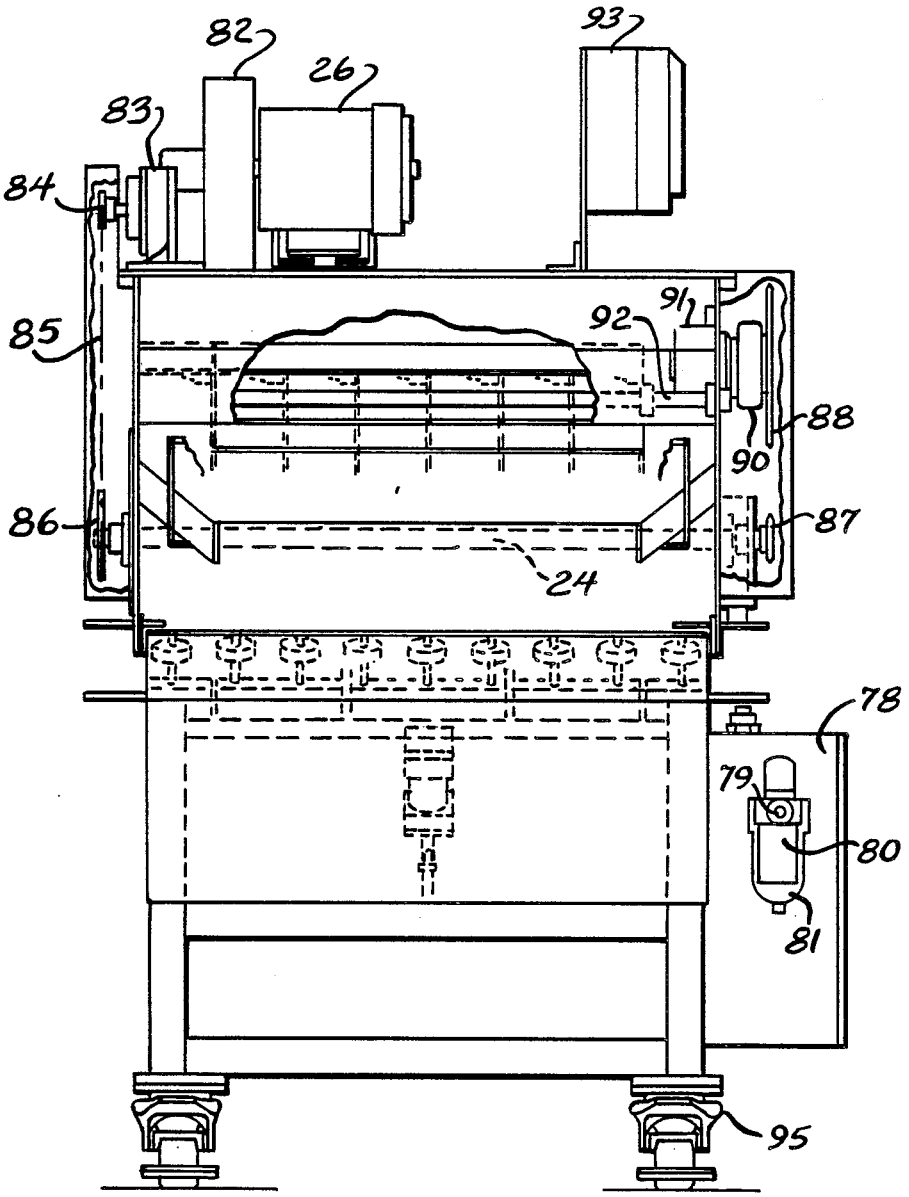
FIG. 3 is a front elevation view with parts broken away of the machine of FIGS. 1 and 2.
Figure 4:
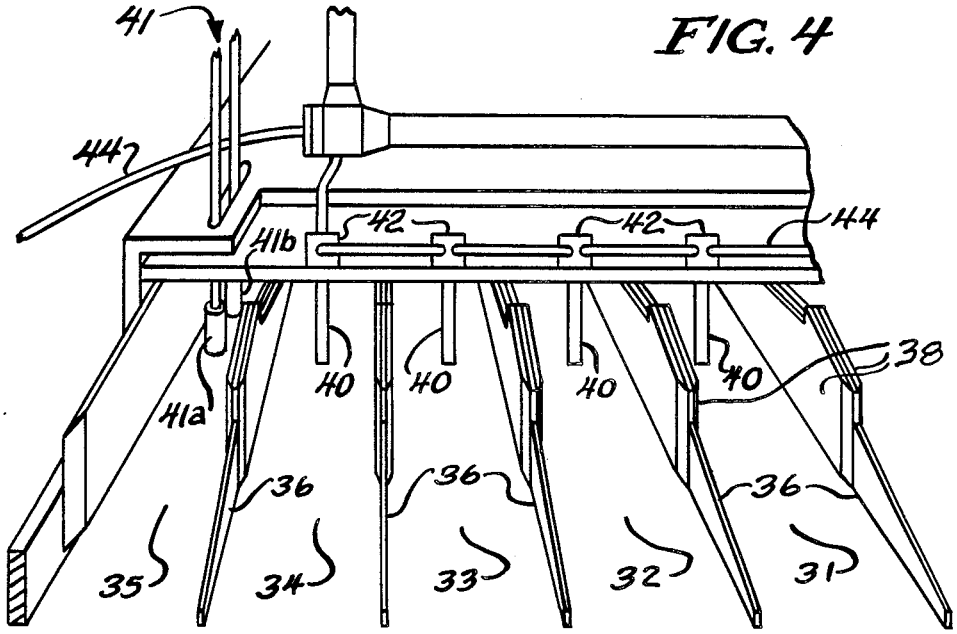
FIG. 4 is a perspective view of part of the machine of FIGS. 1 and 2.

As mentioned, motor 26 drives paddle wheel 50. Motor 26 may illustratively be a one-quarter horsepower electric motor. Referring to FIG. 3, motor 26 is coupled to a variable speed pulley 82. A belt from pulley 82 drives a gear reducer 83 which is coupled to a first sprocket 84. A forty-pitch chain 85 couples first sprocket 84 to a second sprocket 86. Sprocket 86 is coupled to rotate front shaft 24 which includes a plurality of sprockets (not shown) to drive anti-friction belts 20. At the right side of FIG. 3, a third sprocket 87 coupled to and driven by shaft 24 drives a fourth sprocket 88 via a belt 89 (FIG. 1). Sprocket 88 powers a brake 90 with a clutch 91 coupled thereto (FIG. 3). Clutch 91 drives a shaft 92 which is geared to drive paddle wheel 50. The gearing cooperates with limit switches so that 1.5 revolutions (in the illustrated embodiment, nine paddles 52 of paddle wheel 50) occur during each cycle of operation. A cycle can be initiated by manual operation, such as by foot pedal activation (hereinafter described), or an automatic mode of operation can be used so that the machine responds to the presence of another carton to be filled.

Also illustrated in the figures are an electrical box 93 for coupling electrical power to motor 26 and an adjustment device 94 for variable speed pulley 82.

A foot pedal 95 is shown at the bottom left portion of FIG. 1. The foot pedal when actuated commences a cycle of operation. In particular, once the foot pedal 95 is depressed, the paddle wheel 50 begins its cycle of 1.5 revolutions wherein nine sections (illustratively) are rotated. This releases sixty-three tomatoes through holding or counting station 14. Moreover, tomatoes will have been held in the escrow lane 35 by virtue of air cylinder 41*b* having had its arm extended to intercept tomatoes. Air cylinder 41*a* will have had its arm retracted to allow the escrow lane 35 to be loaded, but upon actuation of foot pedal 95, air cylinder 41*a* extends its arm into the path of new tomatoes entering escrow lane 35. Air cylinder 41*a* will have been adjusted in its position along the slidable track so that a predetermined number of escrow tomatoes can fit between air cylinder 41*a* and air cylinder 41*b*, and such escrow tomatoes will then pass from escrow lane 35 into carton 66 during the time that paddle wheel 50 is revolving. Thus, a controlled, counted number of tomatoes is loaded into the carton.

Machine 10 can be adapted to load tomatoes by weight rather than by count. A sensing mechanism beneath carton 66 can signal air logic system 78 to rotate paddle wheel 50 until a preselected weight is developed quickly at carton 66. Then, as an option, escrow lane 35 can provide one, two, or another number of tomatoes to increase the weight of carton 66 at a slower rate until a prescribed weight, or weight range, is developed thereat.

Figure 6:
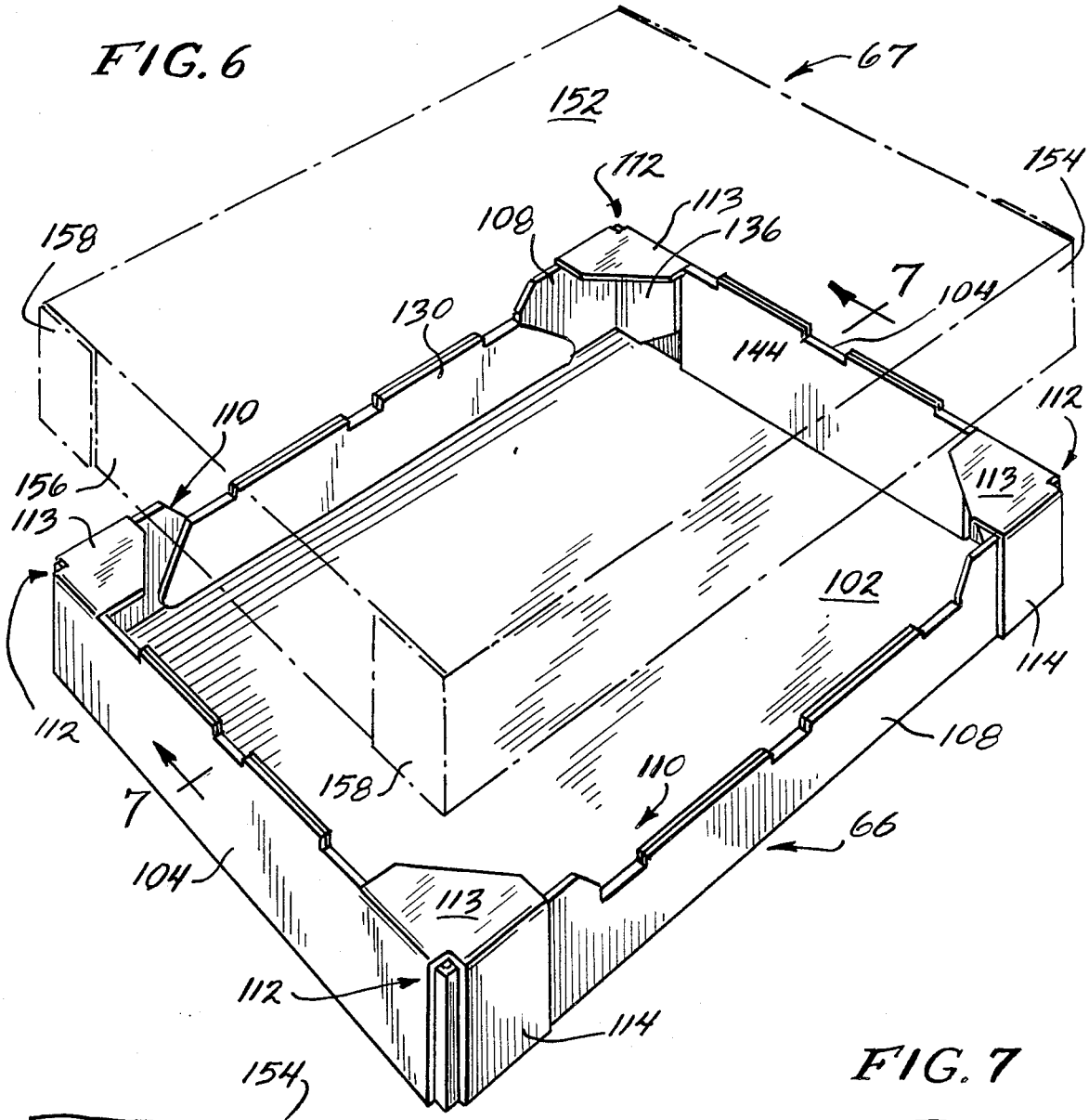
FIG. 6 shows in perspective view a carton configured for use with the machine of FIGS. 1–5, with a lid for the box shown in broken lines.

Carton 66, which is a preferred carton for use with tomato packing machine 10 is shown in its assembled form in FIG. 6, and is shown as an unassembled blank in FIG. 8, where fold lines are indicated by broken lines and score lines are shown as solid lines. A lid 67 can be placed over carton 66 after loading. Lid 67 is shown in its assembled form in broken lines in FIG. 6, and is shown as an unassembled blank in FIG. 9.

Figure 7:
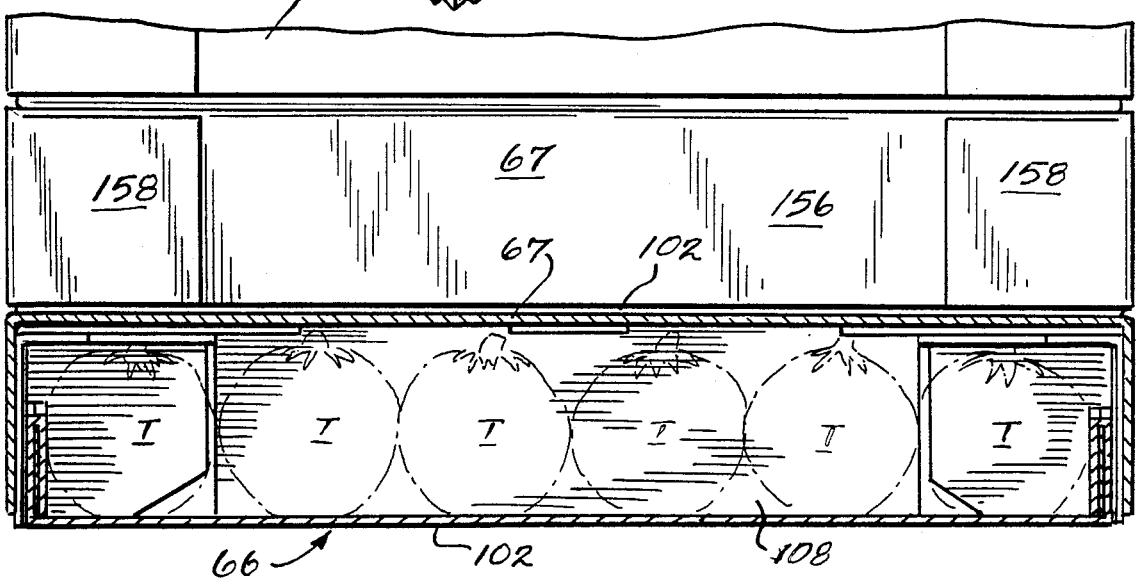
FIG. 7 shows, several cartons and lids in FIG. 6 stacked vertically, with a sectional view of the bottommost carton along line 7—7 in FIG. 6.

As seen generally in FIG. 6, carton 66 has a generally rectangular shape when viewed from above, and, as seen generally in FIG. 7, its side walls have a maximum height greater than the diameter of an average tomato to be packed. Illustratively, the height of carton 66 is about 4 inches, thereby allowing a layer of tomatoes to fit in the carton and permitting an air space between the top surface of the tomatoes and the top of carton 66. Tomatoes T are illustrated in an upright position for illustration purposes only. Typically, in actual practice, the tomatoes will be in a more random orientation, with many of the tomatoes on their sides. Lid 67 also has a generally rectangular shape when viewed from above, and has dimensions to fit over carton 66 from an enclosure area within carton 66 for the tomatoes T.

As illustrated in FIG. 6, carton 66 includes a floor 102 which is generally rectangular in shape. Along the shorter sides of floor 102, side walls 104 extend perpendicularly upwardly from floor 102. Perpendicular side walls 108 form the longer sides of carton 66 and each wall 108 includes a recess 110.

Corner portions 112 extend from the four top corners of carton 66 from side walls 104 and are folded at 90 degree angles with respect to vertical side walls 104 and 108 so that each corner portion forms a support member or element 113 for lid 67 and loads which may be placed over lid 67, which extends in a plane parallel to floor 102. Each corner portion 112 further includes a flap 114 which folds over the adjacent longer wall 108.

Figure 10:
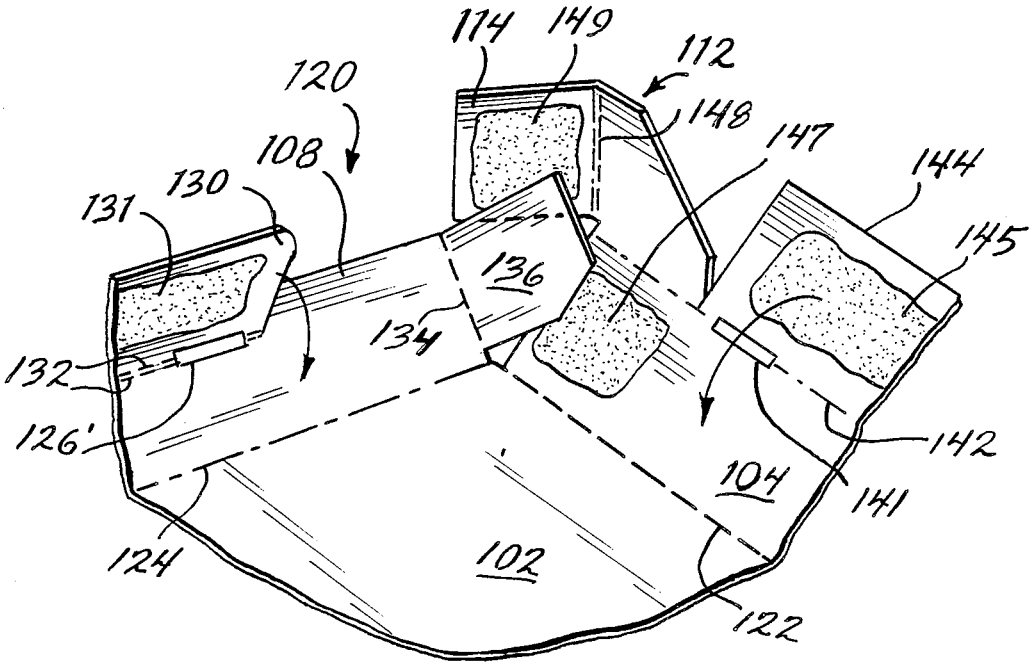
FIG. 10 is a fragmentary view of a corner of the carton in FIG. 6 being folded and glued together.

FIG. 8 illustrates an unassembled blank 120 for making carton 66. Preferably blank 120 is made of corrugated fiberboard, although other materials could be used. Parallel fold lines 122 perpendicular to parallel fold lines 124 comprise inner fold lines which define rectangular floor 102. Flap 130 is defined by two closely spaced parallel fold lines 132 and score lines 133. It will be understood that score lines are cut entirely through blank 120. Flap 130, as shown in FIG. 10, extends from side wall 108 so that when a 90 degree angle is made at fold line 124, side wall 108 becomes perpendicular to floor 102. A 180 degree angle is made at the two fold lines 132 so that flap 130 folds back on side wall 108. Six rectangular holes 126 can be punched adjacent to fold lines 132. Holes 126 can facilitate the folding of flap 130 onto side wall 108. This provides a double thickness of corrugated fiberboard along a long portion of side wall 108. Flap 130 is then secured to side wall 108. As shown in FIG. 10, at least one adhesive patch 131 is preferably used to join flap 130 to side wall 108. Especially preferable for securing flap 130 to side wall 108 is the concurrent use of two types of adhesive or glue: a cold banding adhesive, such as a cold-set resin adhesive, is applied, such as by spraying on, and a hot melt adhesive can be selectively and concurrently placed along flap 130 to assist in holding flap 130 to side wall 108 while the cold resin adhesive sets. The cold-set resin adhesive is preferably applied substantially along the entire length of flap 130 to provide additional structural strength.

Short fold lines 134 on wall 108 perpendicular to fold lines 124 define corner pieces 136. Corner pieces 136 become perpendicular to side wall 108 after a fold is made along fold line 134, and become vertically oriented.

Turning now to the shorter side walls 104, after a fold is made along line 122, wall 104 becomes perpendicular to floor 102. Fold lines 142 permit an outer flap 144 defined by score lines 146 and fold lines 142 to be folded onto wall 104 thereby providing a double thickness of corrugated fiberboard along short side wall 104. Six rectangular holes 141 can be punched along fold lines 142. Holes 141 can facilitate the folding of flap 144 onto side wall 104. Outer flap 144 is secured to wall 104. As shown in FIG. 10, at least one adhesive patch 145 is preferably used to join flap 144 to wall 104, particularly with the two-glue arrangement discussed above.

Side walls 104 and 108 are secured together by securing corner piece 136 on walls 108 to side wall 104. As shown in FIG. 10, an adhesive patch 147 on side wall 104 is preferably used to join corner piece 136 to wall 104, particularly with the two-glue arrangement discussed above.

As shown in FIG. 8, each score line 146 also defines part of corner portion 112, which is coupled to flap 114. Flap 114 is folded along a fold line 148. When corner portion 112 is folded along fold line 142, it extends horizontally. When a fold is made along fold line 148, flap 114 extends vertically downward (after assembly) from corner portion 112 to be glued to the outside of (vertical) side wall 108, as illustrated in FIG. 10. As shown in FIG. 10, at least one adhesive patch 149 is preferably used to join flap 114 to wall 108, particularly with the two-glue arrangement discussed above.

After tomatoes have been loaded in carton 66, lid 67 may be placed over carton 66. FIG. 9 illustrates a blank 150 for making lid 67. Preferably, blank 150 is made of corrugated fiberboard, although other materials could be used. Lid 67 includes lid top surface 152 which is generally rectangular in shape.

Parallel fold lines 160 perpendicular to parallel fold lines 162 compose inner fold lines which define rectangular lid top 152. Side walls 154 are defined along the larger sides of lid top 152 by fold lines 160 and fold lines 164. Side walls 154 are folded downward at 90 degree angles with respect to lid top 152. Similarly, side walls 156 along the shorter sides of lid top 152 are defined by fold lines 162 and score lines 166, and are folded downward at 90 degree angles with respect to lid top 152. At each end of side walls 154 is a flap 158 defined by fold lines 166. After side walls 154 and 156 are folded downward at their 90 degree angles with respect to lid top 152, flaps 158 are folded (inward) at 90 degree angles to wall 154 and secured to the outer surface of side wall 156. At least one adhesive patch 159 is preferably used to join flap 158 to side wall 156, particularly with the two-glue arrangement discussed above.

It will be appreciated that many cartons 66 each with a lid 67 thereon can be stacked vertically with tomatoes therein, as illustrated in FIG. 7. For example, twenty or more cartons can be directly stacked on top of each other without damaging the contents of cartons 66. Consider upper and lower cartons. Floor 102 of the upper carton rests on top of lid 67. Lid 67 prevents the floor 102 from the carton above from falling into and crushing tomatoes in the lower carton. Additionally, the lower edges of the intersection of floor 102 and side walls 104 and walls 108 of the upper carton rest on lid top 152 of lid 67. Additionally, support members 113 prevent the upper carton from falling into and crushing tomatoes in the lower carton.

A second embodiment of a carton 66', which has similarities to carton 66, can be used without a lid. Carton 66' is shown in its assembled form in FIG. 11, and the carton is shown as an unassembled blank 150' in FIG. 12, where fold lines are indicated by broken lines and score lines are shown as solid lines. As seen generally in FIG. 11, carton 66' has a generally rectangular shape when viewed from above, and its side walls have a maximum height greater than the diameter of an average tomato. Illustratively, the height of carton 66' is about 4 inches, thereby allowing a layer of tomatoes to fit in the carton and permitting an air space between the top surface of the tomatoes and the top of carton 66'.

Figure 11:
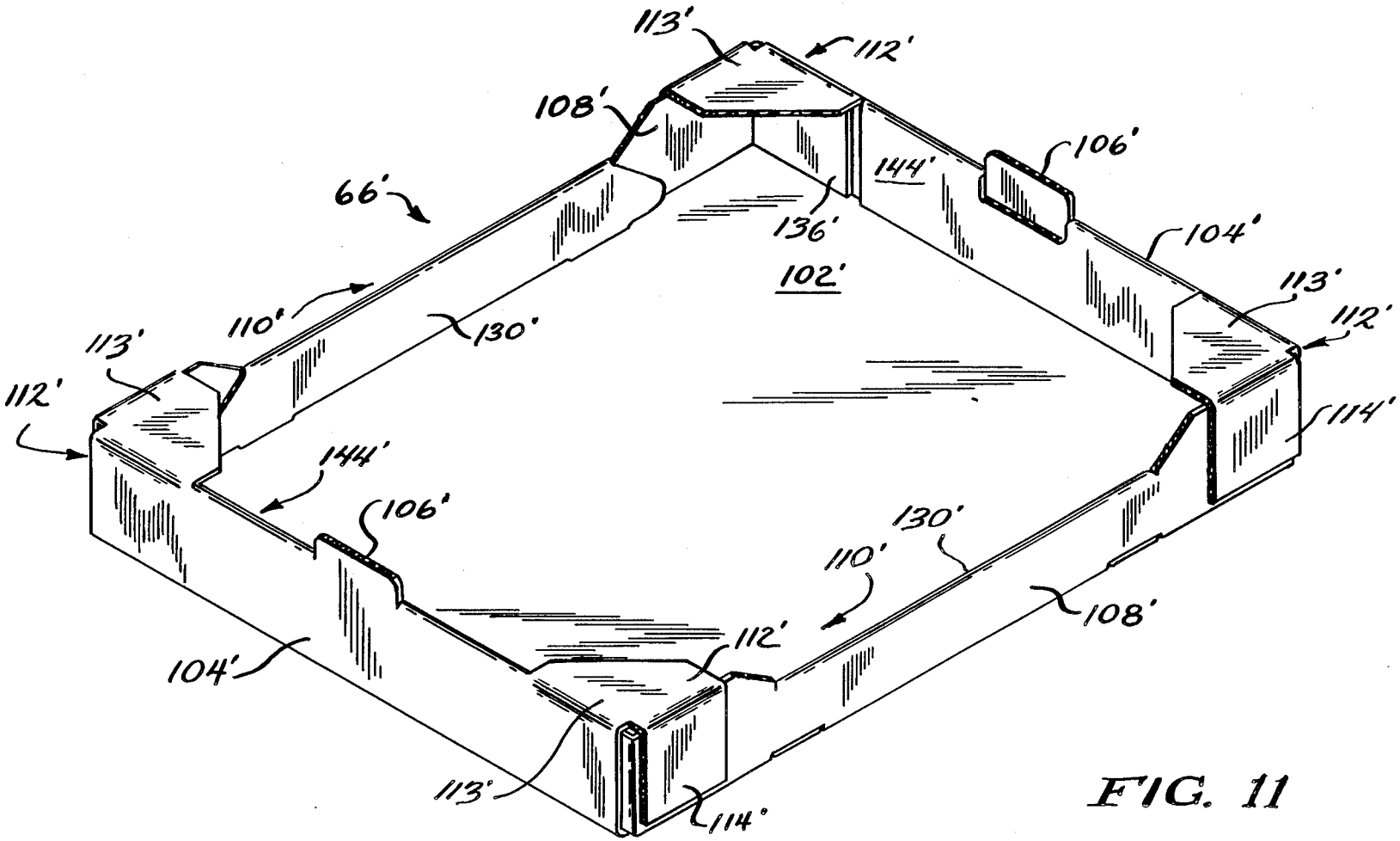
FIG. 11 shows a second embodiment of a carton configured for use with the machine of FIGS. 1–5.
Figure 12:
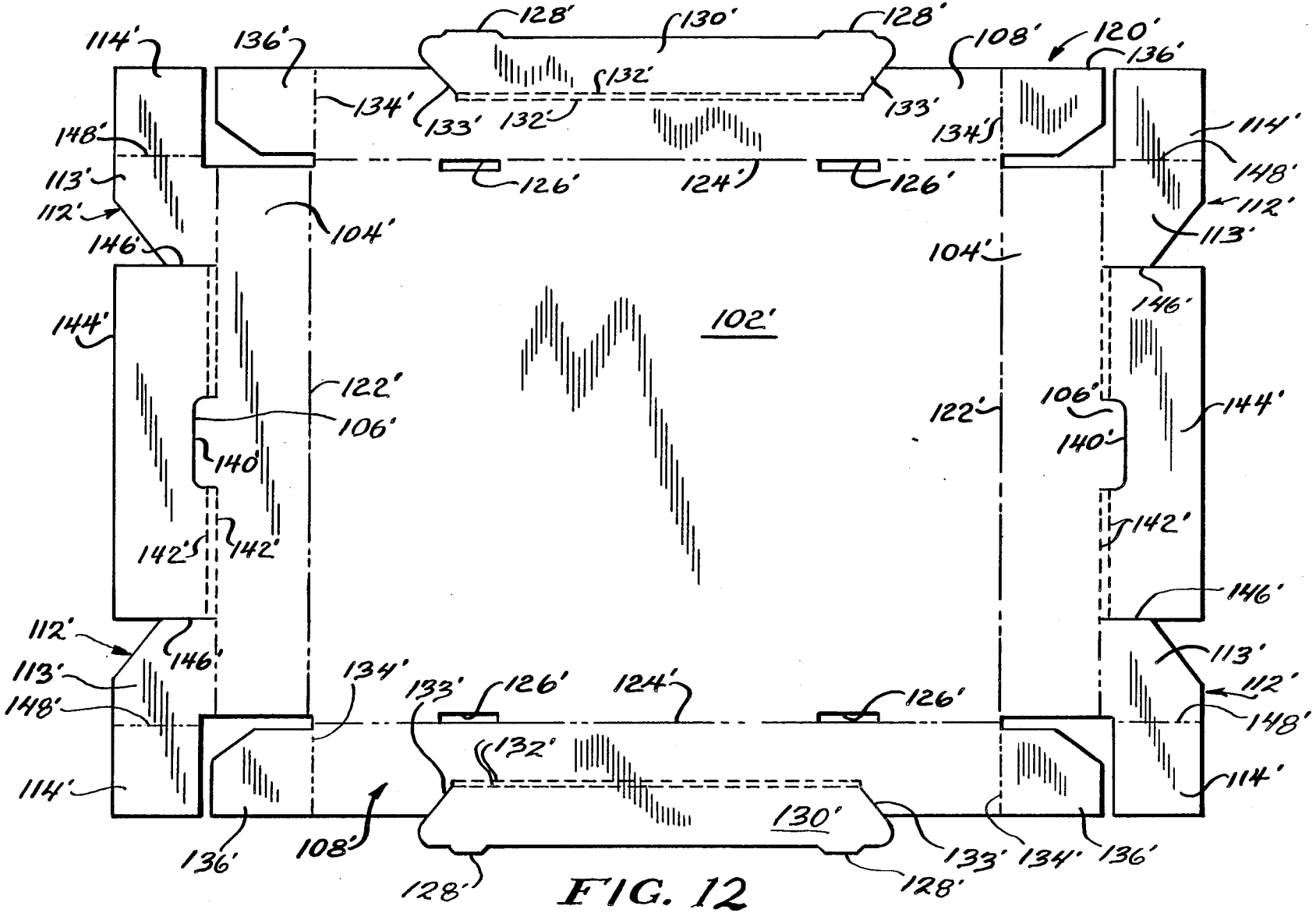
FIG. 12 is a plan view of an unassembled blank of the carton in FIG. 11.

As illustrated in FIGS. 11 and 12, carton 66' includes a floor 102' which is generally rectangular in shape. Along the shorter sides of floor 102', side walls 104' extend perpendicularly upwardly from floor 102'. Each side wall 104' includes a tab 106' extending upward from the main portion of wall 104'. Perpendicular side walls 108' form the longer sides of carton 66' and each wall 108' includes a recess 110'.

Corner portions 112' extend from the four top corners of carton 66' from side walls 104' and are folded at 90 degree angles with respect to vertical side walls 104' and 108' so that each corner portion forms a support member or element 113' for loads which may be placed thereon, which extends in a plane parallel to floor 102'. Each corner portion 112' further includes a flap 114' which fold over the adjacent longer wall 108'.

FIG. 12 illustrates an unassembled blank 120' for making carton 66' and FIG. 11 illustrates an assembled carton 66'. Preferably, blank 120' is made of corrugated fiberboard, although other materials can be used. Parallel fold lines 122' perpendicular to parallel line 124' comprise inner fold lines which define rectangular floor 102'. Four rectangular holes 126' can be punched adjacent to fold lines 124'. Holes 126' can facilitate the folding of a long flap 130' onto side wall 108'. Holes 126' are used to engage outer tabs 128' on long flap 130', long flap 130' being defined by two closely spaced parallel fold lines 132' and score lines 133'. It will be understood that score lines are cut entirely through blank 120'. Flap 130' extends from side wall 108' so that when a 90 degree angle is made at fold line 124', side wall 108' becomes perpendicular to floor 102'. A 180 degree angle is made at the two fold lines 132' so that flap 130' folds back on side wall 108' to let tabs 128' engage holes 126'. This provides a double thickness of corrugated fiberboard along a large portion of side wall 108'. Flap 130' is secured to side wall 108', preferably with the two-glue arrangement discussed above.

Short fold lines 134' on wall 108' are perpendicular to fold lines 124' and define the corner pieces 136'. Corner pieces 136' become perpendicular to side wall 108' after a fold is made along line 134', and become vertically oriented.

Turning now to the shorter walls 104', after a fold is made along line 122', wall 104' becomes perpendicular to floor 102'. A score line 140' defines tabs 106', and fold lines 142' permit an upper flap 144' defined by score lines 146' and fold lines 142' to be folded onto wall 104' thereby providing a double thickness of corrugated fiberboard along the short side wall 104'. Flap 144' is secured to side wall 104', preferably with the two-glue arrangement discussed above.

Side walls 108' and 104' are secured together by securing corner pieces 136' on walls 108' to side walls 104', preferably with the two-glue arrangement discussed above.

Each score line 146' also defines part of corner portion 112', which is coupled to flap 114'. Flap 114' is folded along a fold line 148'. When corner portion 112' is folded along fold line 142', it extends horizontally. When a fold is made along fold line 148', flap 114' extends vertically downward (after assembly) from corner portion 112' to be secured to the outside of (vertical) side wall 108', preferably by the two-glue arrangement discussed above.

It will be appreciated that many cartons 66' can be stacked vertically with tomatoes T therein. For example, fourteen to twenty or more cartons 66' can be directly stacked on top of each other without damaging the contents of carton 66'. Consider upper and lower cartons stacked on floor F. Floor 102' of the upper carton rests on top corner portions 112' of the lower carton. Specifically, support members 113' prevent the floor 102' from the carton above from falling into and crushing tomatoes in the lower carton. Further, side o walls 104' of the upper carton are engaged by the upstanding tabs 106' of the lower carton. The tabs 106' serve to hold the upper and lower cartons in place. Tabs 106' are pushed slightly outward when an upper carton 66' is stacked onto the lower carton 66'. Because of the large recesses 110', there will be air flow over the tomatoes in each carton 66', notwithstanding that another carton may be stacked on top of it.

While simple in construction, carton 66 provides a very economic use of corrugated fiberboard as it can be seen that there is very little waste. Moreover, even though only a single wall corrugation is used in the preferred embodiment, carton 66 exhibits enough strength to support 25 pounds or more of tomatoes. Double thickness corrugation can be used, and other variations in construction can be made. By packing the tomatoes in a single layer in carton 66, spoilage is reduced in three ways. First, there is no pressure on any tomato from a tomato above it. Second, if one tomato spoils, there are no tomatoes beneath it which will be contaminated by the spoilage. Also, there is no spoilage due to concussion bruising. It should be noted that if there is any natural spoilage of a single tomato or fruit, the corrugated fiberboard carton absorbs moisture, decay and spoilage directly below the tomato or fruit.

Another advantage of carton 66 is that it is preferably dimensioned so that four such cartons can be arrayed in a two-by-two contiguous arrangement which matches the size of a standard 48-inch by 40-inch pallet. This promotes stacking numerous cartons 66 in two-by-two arrangements, four cartons to a layer, on a single shipping pallet which can then be transported easily.

It will be appreciated that the embodiments described herein are capable of various modifications and alterations within the scope and spirit of the present invention. Accordingly, this specification and drawings are intended in an illustrative and non-limiting sense.

What is claimed is:

1. A machine for packing items such as tomatoes or the like comprising:

a rear portion where items to be packed are received;

a holding station;

a front portion where items to be packed are discharged including a paddle wheel, a surface underneath the paddle wheel and a machined surface extending downstream of the paddle wheel for rolling the items downwardly and into a carton, the paddle wheel rotatable about an axis above the items to be packed and perpendicular to the direction of travel of items to be packed for transporting and discharging a row of said items to be packed by sweeping the items along the surface underneath said paddle wheel and onto the inclined surface;

means for transporting items to be packed from said rear portion to said holding station;

said rear portion including lane means for organizing said items to be packed into discrete lanes;

a control device associated with said station for releasing a row of said items to be packed to said front portion; and said front portion being configured so that said items to be packed roll into a carton positioned at said front portion.

2. The packing machine of claim 1 wherein said lane means comprises a plurality of parallel divider walls extending in a direction parallel to the direction of movement of the items to be packed.

3. The packing machine according to claim 2 wherein each said lane divider includes a top surface which is inclined with respect to said means for transporting so that said items to be packed, as they move toward said station, are divided into lanes by gradually rising lane dividers.

4. The packing machine according to claim 1 further comprising tapered walls coupled to said lane means and positioned to narrow the lane opening in which an item to be packed can travel toward said holding station.

5. The packing machine according to claim 1 wherein said means for transporting comprises a plurality of separate belts each corresponding to a single said lane, said belts extending in endless loops between the back of said rear portion and said holding means.

6. The packing machine according to claim 5 wherein each said belt includes a plurality of rollers, said rollers being supported for rotation about axes which are oriented perpendicular to the direction of movement of said items to be packed.

7. The packing machine according to claim 1 wherein said means for transporting comprises a low backline pressure belt.

8. The packing machine according to claim 1 wherein said control device includes fingers extending into said lanes and positioned to be mechanically operated by the items to be packed in connection with entering said station.

9. The packing machine according to claim 8 wherein said fingers are coupled to logic devices for determining whether said items to be packed occupy said lanes at said station.

10. The packing machine according to claim 9 wherein said logic devices comprise air logic.

11. The packing machine according to claim 1 wherein said paddle wheel includes flexible radial paddles each separated from its adjacent paddle by a space sufficient to accommodate an item to be packed between one paddle and its adjacent paddle.

12. The packing machine according to claim 1 wherein said station comprises a plurality of active lanes and an escrow lane.

13. The packing machine according to claim 1 wherein said front portion includes an inclined chute positioned to receive items to be packed from said station and directing them into a carton.

14. The packing machine according to claim 1 further comprising a roller for guiding cartons to a position proximate to said inclined chute.

15. The packing ,machine according to claim 14 wherein said roller has a transverse incline so that said items to be packed which are discharged from said front portion into said carton roll to a lower-most portion of said carton.

16. The packing machine according to claim 1 further comprising means for weighing the carton and the tomatoes loaded therein, said weighing means being associatively connected with said station to pack a predetermined weight of tomatoes into said carton.

17. The packing machine according to claim 16 wherein said weighing means comprises a sensing mechanism beneath said carton.

18. The packing machine according to claim 16 wherein said station comprises a plurality of active lanes and an escrow lane, whereby the escrow lane is used to lead the tomatoes into said carton at a slower rate than with said active lanes until said predetermined weight is attained.

19. The machine of claim 1 further comprising reciprocating means for oscillating said rear portion from side-to-side.

20. A machine for packing items such as tomatoes or the like comprising:

a rear portion where items to be packed are received;

a holding station comprising a plurality of lanes and an escrow lane;

a front portion where items to be packed are discharged;

means for transporting items to be packed from said rear portion to said holding station;

said rear portion including lane means for organizing said items to be packed into discrete lanes;

a control device associated with said station for releasing a row of said items to be packed to said front portion; and said front portion being configured so that said items to be packed roll into a carton positioned at said front portion.

21. The packing machine according to claim 20 further comprising a switch coupled to said control device for discharging items to be packed from said escrow lane.

22. A method for packing items such as tomatoes or the like comprising:

transporting said items from a receiving portion to a station;

dividing said items into plural active lanes and an escrow lane as they are transported to said station;

intercepting said items to be packed at said station and arranging them into a row of parallel items to be packed;

discharging a row of said items to be packed from said active lanes to a front portion;

at least intermittently discharging an item to be packed from said escrow lane to the front portion when said row of items is discharged from said active lanes;

rolling said items to be packed after they are discharged into a carton.

23. The method according to claim 22 wherein said items comprise tomatoes.

24. The method according to claim 22 including oscillating a rear portion of a packing machine thereby to rarefy said items to be packed to several lanes.

25. The method according to claim 22 further comprising reciprocating a front portion of a packing machine to distribute items being packed in a single-layer carton.

26. The method according to claim 22, said intercepting step including collecting said items to be packed in a row at a paddle wheel; said discharging step comprising turning said paddle wheel.

27. The method according to claim 22 further comprising detecting when a plurality of lane positions at a station are occupied by items to be packed, and discharging said items after said detecting.

28. A machine for packing items such as tomatoes or the like comprising:

a rear portion where items to be packed are received;

a holding station comprising a plurality of active lanes and an escrow lane, whereby the escrow lane is used to lead the tomatoes into said carton at a slower rate than with said active lanes until said predetermined weight is attained;

a front portion where items to be packed are discharged;

means for transporting items to be packed from said rear portion to said holding station;

said rear portion including lane means for organizing said items to be packed into discrete lanes;

a control device associated with said station for releasing a row of said items to be packed to said front portion;

said front portion being configured so that said items to be packed roll into a carton positioned at said front portion;

means for weighing the carton and the tomatoes loaded therein, said weighing means being associatively connected with said station to pack a predetermined weight of tomatoes into said carton.

* * * * *

UNITED STATES PATENT AND TRADEMARK OFFICE

CERTIFICATE OF CORRECTION

PATENT NO. : 4,981,008

DATED : January 1, 1991

INVENTOR(S) : Edward L. Ott, James P. Zavodsky, Carl D. Deshich

It is certified that error appears in the above-identified patent and that said Letters Patent is hereby corrected as shown below:

Col. 2, line 57, after "shows" delete the comma ",".

Col. 3, line 37, delete "infra" and insert therefor --infra--.

Col. 4, line 30, after "escrow" insert --lane. Preferably, air cylinder 41a is mounted in a--.

Col. 10, line 45, after "side" delete "o".

Col. 11, line 22, delete "a machined" and insert therefor --an inclined--.

Col. 12, line 28, delete ",machine" and insert --machine--.

Signed and Sealed this

Second Day of March, 1993

*Attest:*

STEPHEN G. KUNIN

*Attesting Officer*

*Acting Commissioner of Patents and Trademarks*